US008950091B2

(12) United States Patent
Cover

(10) Patent No.: US 8,950,091 B2
(45) Date of Patent: Feb. 10, 2015

(54) DRAGLINE BUCKET WITH REMOTE DUMPING AND POSITIONING CAPABILITIES

(75) Inventor: Stuart Cover, Queensland (AU)

(73) Assignee: Caterpillar Global Mining LLC, Oak Creek, MI (US)

( * ) Notice: Subject to any disclaimer, the term of this patent is extended or adjusted under 35 U.S.C. 154(b) by 254 days.

(21) Appl. No.: 13/430,454

(22) Filed: Mar. 26, 2012

(65) Prior Publication Data

US 2013/0247426 A1 Sep. 26, 2013

(51) Int. Cl.
*E02F 3/48* (2006.01)

(52) U.S. Cl.
USPC ..... 37/396; 37/395; 37/398

(58) Field of Classification Search
CPC ..... E02F 3/48; E02F 3/46; E02F 3/54; E02F 3/58; E02F 3/627; E02F 3/42; E02F 3/425; E02F 3/432; E02F 3/436
USPC ..... 37/395–399, 444; 60/413, 414; 90/508
See application file for complete search history.

(56) References Cited

U.S. PATENT DOCUMENTS

| | | | | |
|---|---|---|---|---|
| 833,333 | A | 10/1906 | Neuman | |
| 887,990 | A | 5/1908 | Weeks | |
| 1,242,320 | A | 10/1917 | Burkett | |
| 1,401,319 | A | 12/1921 | Crawford | |
| 2,120,444 | A | 6/1938 | Smith | |
| 2,158,061 | A | 5/1939 | Atkins et al. | |
| 2,511,883 | A | 6/1950 | Thierry | |
| 2,813,645 | A * | 11/1957 | Pilch | 414/694 |
| 3,278,057 | A * | 10/1966 | Drollinger et al. | 414/716 |
| 3,335,642 | A | 8/1967 | Rosaen | |
| 3,597,865 | A | 8/1971 | Rumfelt | |
| 3,877,349 | A | 4/1975 | Schindel | |
| 3,971,215 | A * | 7/1976 | Baron et al. | 60/403 |
| 4,060,221 | A | 11/1977 | Rilbe | |
| 4,476,641 | A | 10/1984 | Ballinger | |
| 4,531,451 | A | 7/1985 | Mouton | |
| 4,984,509 | A | 1/1991 | Hoshi | |
| 5,499,463 | A * | 3/1996 | Profio et al. | 37/398 |
| 5,992,061 | A | 11/1999 | Fleck et al. | |
| 6,186,013 | B1 * | 2/2001 | Gabiniewicz et al. | 73/865.9 |
| 6,413,031 | B1 | 7/2002 | Yakley et al. | |
| 6,446,366 | B1 | 9/2002 | Briscoe et al. | |
| 6,588,126 | B2 * | 7/2003 | Leslie et al. | 37/394 |
| 6,826,466 | B2 | 11/2004 | Rowlands et al. | |
| 7,152,349 | B1 | 12/2006 | Rowlands | |
| 7,337,885 | B2 | 3/2008 | Stow | |
| 7,658,023 | B2 * | 2/2010 | Wallett | 37/345 |
| 7,721,473 | B2 | 5/2010 | Lunn | |
| 7,774,959 | B2 | 8/2010 | Kubo et al. | |
| 2005/0193598 | A1 | 9/2005 | Buhse | |
| 2006/0107556 | A1 | 5/2006 | Rowlands | |
| 2007/0240341 | A1 | 10/2007 | Hyde | |
| 2008/0165025 | A1 * | 7/2008 | Morath | 340/825.23 |
| 2013/0086899 | A1 * | 4/2013 | Sefcik | 60/459 |

* cited by examiner

*Primary Examiner* — Robert Pezzuto
*Assistant Examiner* — Jessica Lutz
(74) *Attorney, Agent, or Firm* — Foley & Lardner LLP

(57) ABSTRACT

A dragline bucket includes a main body moveable between a digging orientation and a dumping orientation and a pivotable spreader beam coupled to the main body at a pivot point. The dragline bucket further includes an energy capture mechanism including an actuator coupled to the main body and the pivotable spreader beam and an energy storage mechanism coupled to the actuator.

10 Claims, 6 Drawing Sheets

DRAGLINE BUCKET WITH REMOTE DUMPING AND POSITIONING CAPABILITIES

FIELD

This disclosure relates generally to the field of buckets for large mining draglines, and particularly to a self-energized, remote controlled bucket for a dragline.

BACKGROUND

Draglines are utilized in mining operations to strip the overburden (e.g., rocks, soil, etc.) above a seam or deposit of a material such as coal or an ore with a large bucket that is dragged across the ground. The path of the bucket is controlled with hoist ropes and drag ropes. The dumping action for conventional buckets are not directly controlled, but are instead controlled through adjusting the tension of the drag ropes through a dump rope mechanism.

Universal dig dump mechanisms exist which allow the direct control of bucket dumping action through the use of multiple hoist ropes (i.e., hoist ropes coupled to both the front and the rear of the bucket) and alternating the lengths of the hoist ropes. However, such universal dig dump systems are more expensive than a conventional system because of modifications to the boom, the addition of a split hoist drum, and extra motors and gearcases. Further, the alternating of the lengths of the hoist ropes applies alternating loads at the sheaves on the end of the boom, creating potential fatigue loading.

SUMMARY

One embodiment relates to a dragline bucket including a main body moveable between a digging orientation and a dumping orientation and a pivotable spreader beam coupled to the main body at a pivot point. The dragline bucket further includes an energy capture mechanism including an actuator coupled to the main body and the pivotable spreader beam and an energy storage mechanism coupled to the actuator.

Another embodiment relates to a dragline including a housing including hoist machinery and drag machinery, a hoist rope coupled to the hoist machinery, and a drag rope coupled to the drag machinery. The dragline further includes a bucket coupled to the hoist rope and the drag rope, and an energy capture mechanism coupled to the bucket. The bucket is moveable about a pivot point between a digging orientation and a dumping orientation. The energy capture mechanism includes an actuator an energy storage device; and a remote control unit configured to receive control signals from an operator of the dragline to operate the actuator. The actuator stores energy in the energy storage mechanism as the bucket moves from the digging orientation to the dumping orientation. The stored energy may be utilized to operate the actuator to position the bucket in the digging orientation.

Another embodiment relates to a method for manufacturing a dragline bucket. The method includes coupling a spreader beam to a bucket at a pivot point; coupling an actuator to the spreader beam and the bucket; and coupling an energy storage device to the actuator. The method further includes providing control valves configured to transfer energy from the actuator to the energy storage device as the bucket moves from a digging orientation to a dumping orientation and to transfer energy from the energy storage device to the actuator to move the bucket from the dumping orientation to the digging orientation.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
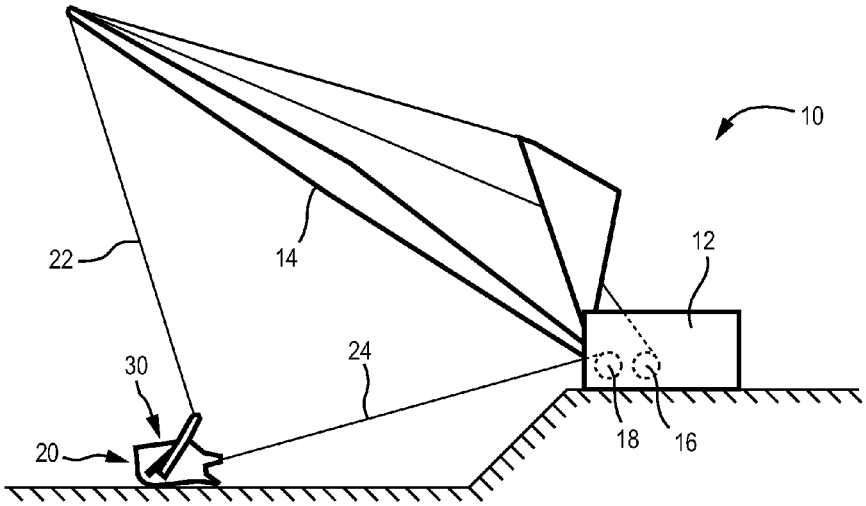
FIG. 1 is a schematic side view of a dragline including a bucket, in accordance with an exemplary embodiment.

Referring to FIG. 1, a dragline 10 is shown schematically according to an exemplary embodiment. The dragline 10 is configured to remove material (e.g., overburden) with a bucket 20. The bucket 20 is manipulated utilizing hoist machinery 16 and drag machinery 18 in a housing 12. The hoist machinery 16 is coupled to the bucket with a hoist rope 22 (e.g., cable, etc.) extending from the hoist machinery 16, over sheaves on the end of a forwardly extending boom 14, and to the bucket 20. The drag machinery 18 is coupled to the bucket 20 with a drag rope 24 (e.g., cable, etc.). The hoist machinery 16 and the drag machinery 18 are controlled by an operator in a machine cabin located in the dragline housing 12.

Figure 2B:
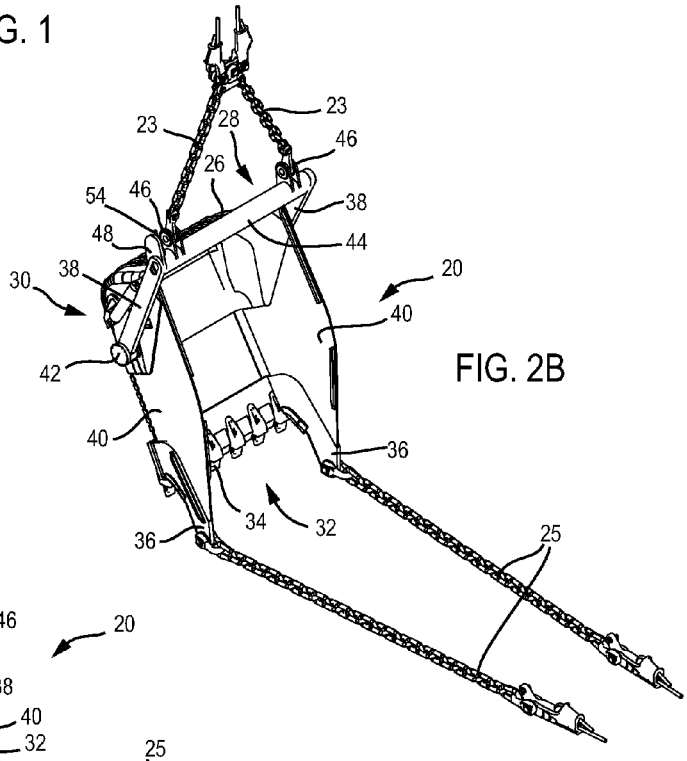
FIGS. 2A and 2B are perspective views of a bucket for a dragline including an energy capture mechanism, in accordance with an exemplary embodiment.
Figure 2A:
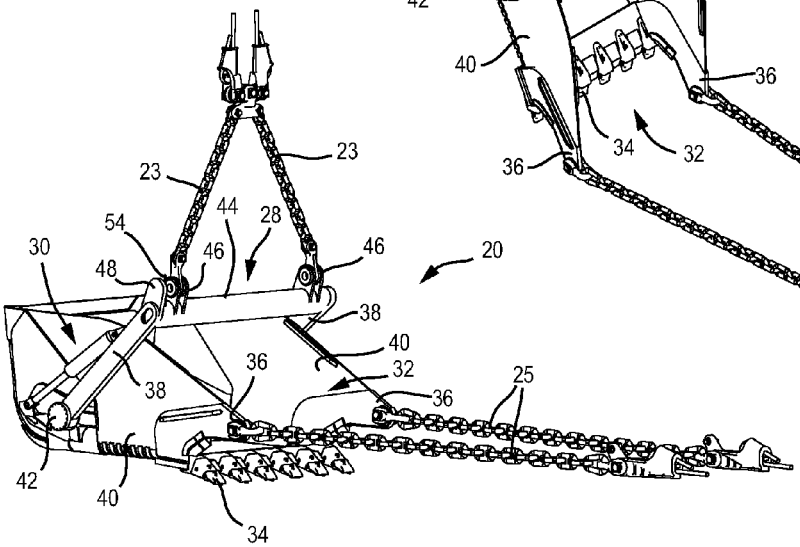

Referring to FIGS. 2A-2B, the bucket 20 includes a main body 26, a spreader beam 28, and an energy capture mechanism 30. The main body 26 is shown as a box-like structure with an open top and an open front end 32. The open front end 32 of the body 26 may include replaceable teeth 34. The drag rope 24 is connected to forwardly extending mounting lugs 36 with splayed drag chains 25, sometimes referred to as drag "jewelry". The spreader beam 28 includes two arms 38 that are pivotably coupled to the side walls 40 of the body 26 at pivot points 42. The arms 38 are coupled together by a cross-member 44 to form a U-shaped member. The hoist rope 22 is connected to upwardly extending lugs 46 on the cross-member 44 with splayed hoist chains 23, sometimes referred to as hoist "jewelry".

The bucket 20 is moved along a digging path through the taking up and paying out of the hoist ropes 22 and the drag ropes 24 by the hoist machinery 16 and the drag machinery 18, respectively. The housing 12 and the boom 14 are first rotated to align the bucket 20 with the material to be removed. The hoist rope 22 and the drag rope 24 are slackened (i.e., payed out) to lower the bucket 20 to the ground. The bucket 20 is then drawn across the ground towards the housing 12 by taking up the drag rope 24 with the digging depth of the bucket 20 is maintained by controlling the tension of the hoist rope 22. As the bucket 20 is pulled towards the housing 12, it is filled with material through the open front end 32. Once the bucket 20 has been filled, it is lifted from the ground by taking up the hoist rope 22 and maneuvered to a dump location in which to empty the bucket 20. The bucket 20 is emptied by actuating a valve (e.g., dump valve 78 shown in FIG. 7), allowing the weight of the bucket 20 (and the material payload within the bucket 20) to rotate the open front end 32 of the bucket 20 downward to empty the material from the bucket 20.

Figure 3:
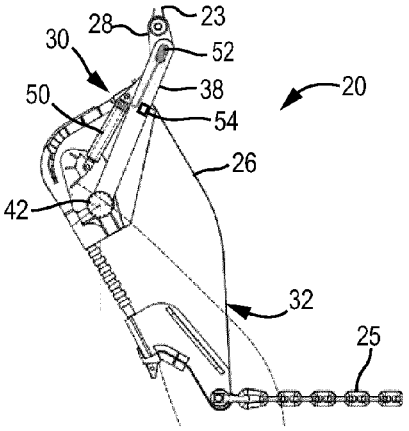
FIG. 3 is a side view of the bucket of FIG. 2B in a first or dumping position.
Figure 4:
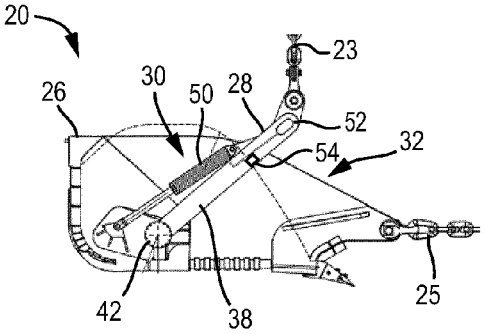
FIG. 4 is a side view of the bucket of FIG. 2A in a second or digging position.

Referring now to FIGS. 3-4, the crowd movement (e.g., rotation or tilt) of the bucket 20 is remote controlled from the machine cabin, but powered by stored energy onboard the bucket 20 with the energy capture mechanism 30. According to an exemplary embodiment, the energy capture mechanism 30 is an electric over hydraulic system with electric solenoids controlling hydraulic valves. The incompressibility of the fluid in a hydraulic system gives the energy capture mechanism an enhanced holding ability. The energy stored onboard the bucket 20 by the energy capture mechanism 30 is continually recharged through an energy storage mechanism by the movement of the dragline bucket 20. For example, as the bucket 20 moves (e.g., falls; rotates, etc.) into a dumping position, thus emptying the collected material out of the open end 32 (see FIG. 3), the weight of the material payload compresses hydraulic fluid from an actuator 50 into the energy storage mechanism, shown by way of example as an accumulator 52. In one exemplary embodiment, the accumulator 52 may be provided within the spreader beam 28. In other embodiments, the accumulator may be provided elsewhere, such as coupled to the outside of the spreader beam 28 or to the side of the bucket 20. This compressed fluid may be utilized later in the digging cycle to operate the actuator 50 and adjust the now empty bucket 20 into position for the next digging pass (see FIG. 4). The energy capture mechanism 30 receives control signals remotely from the operator with a wireless receiver 54 that is powered by a replaceable on-board energy source (e.g., a replaceable battery) or a rechargeable on-board energy source (e.g., a generator driven by the flow of oil). In one exemplary embodiment, the wireless receiver 54 is provided on the spreader beam 28, next to one of the hoist lugs 46. A protective lug or shield 48 may be provided on the other side of the wireless receiver 54 to guard the receiver 54 from debris. In other embodiments, the wireless receiver may be coupled to other internal or external locations on the bucket 20 (e.g., within the spreader beam 28).

While the energy capture mechanism will be described in detail in several exemplary embodiments as a hydraulic system, it should be understood that the principles are applicable to other types of energy storage systems as well, such as electrical, pneumatic, or mechanical systems. For example, in other exemplary embodiments the energy storage mechanism may be an electric motor and electrical energy may be stored in a device such as a capacitor or a battery. In other exemplary embodiments, the energy storage mechanism may be a mechanical linkage and kinetic energy may be stored in a device such as a flywheel.

As shown in FIGS. 3-4, in one embodiment the actuator 50 is a linear actuator such as a hydraulic cylinder (e.g., hydraulic ram, hydraulic piston, etc.). Linear actuators have good holding ability and efficiency (e.g., a high ratio of energy/fluid capture to energy/fluid use) due to positive displacement operation. With such a positive displacement actuator, all the hydraulic fluid is captured in the accumulator when the bucket dumps. If a single conventional double acting actuator is utilized on either side of the bucket, the applicant believes that enough energy is stored in the dumping motion by the pressurized fluid in the accumulator to bring the bucket back into position (e.g., into the digging orientation). The applicant believes that a single conventional actuator stores more energy in the pressurized fluid during compression (e.g., during a dumping operation of a fully loaded bucket) than is used during extension (e.g., to bring the bucket back into position). However, the actuator cannot utilize a lesser volume of the pressurized fluid to extend the actuator than was forced out when the actuator was compressed. A certain amount of energy is therefore wasted with a single conventional actuator.

Figure 5:
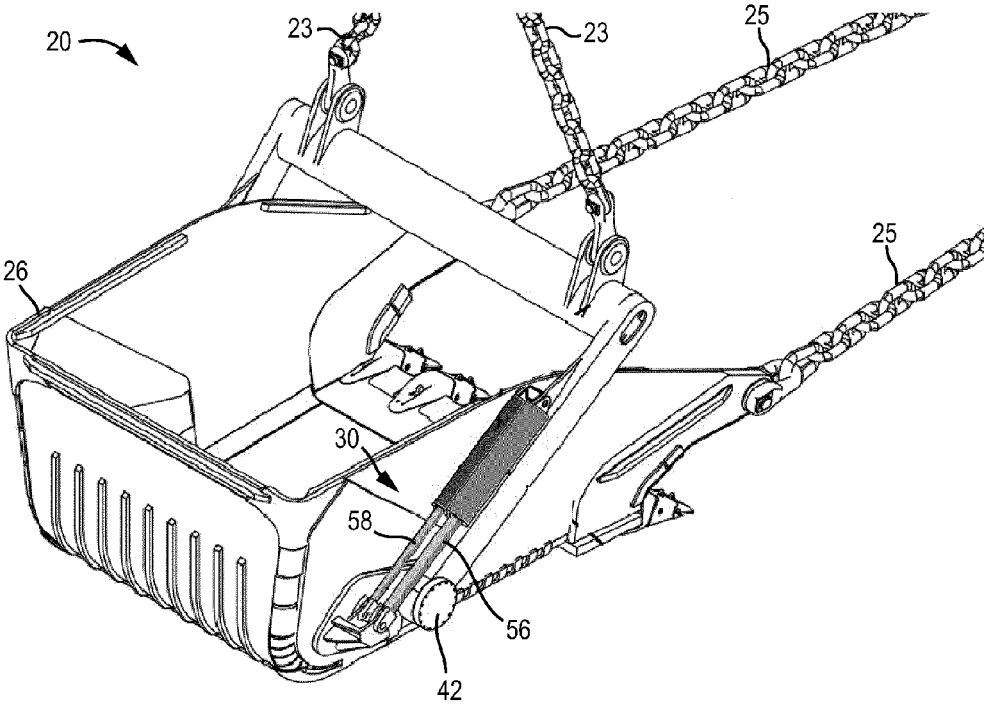
FIG. 5 is a perspective view of the bucket of FIG. 2A with an energy capture mechanism including two linear actuators, in accordance with an exemplary embodiment.

Referring now to FIG. 5, according to another exemplary embodiment, instead of a single conventional actuator on either side of the bucket 20, the energy capture mechanism may utilize multiple actuators on either side of the bucket 20, such as a large bore linear actuator 56 and a small bore linear actuator 58. The use of multiple actuators 56 and 58 on either side of the bucket 20 allows the energy stored in the energy capture mechanism 30 to be utilized to raise the bucket 20 back into a digging position, but also to reposition the bucket 20 one or more times for the next digging pass. Both the large bore actuators 56 and the small bore actuators 58 are used to hold the bucket 20 in the generally horizontal digging orientation. As the bucket 20 is emptied, the spreader beam 28 rotates about the pivot points 42, compressing both actuators 56 and 58. The compressed fluid from both actuators 56 and 58 are captured in an energy storage mechanism. According to one embodiment, only the small bore actuators 58 are extended to actuate the movement of the empty bucket 20 back into the digging position, requiring less volume than would be used to extend both the large actuators 56 and the small actuators 58 and allowing for several adjustments to be potentially made to the crowd position of the bucket 20. As the bucket 20 is repositioned by the small bore actuators 58, the large bore actuators 56 are also extended, drawing fluid from the reservoir to be captured at the next dump.

Figure 6:
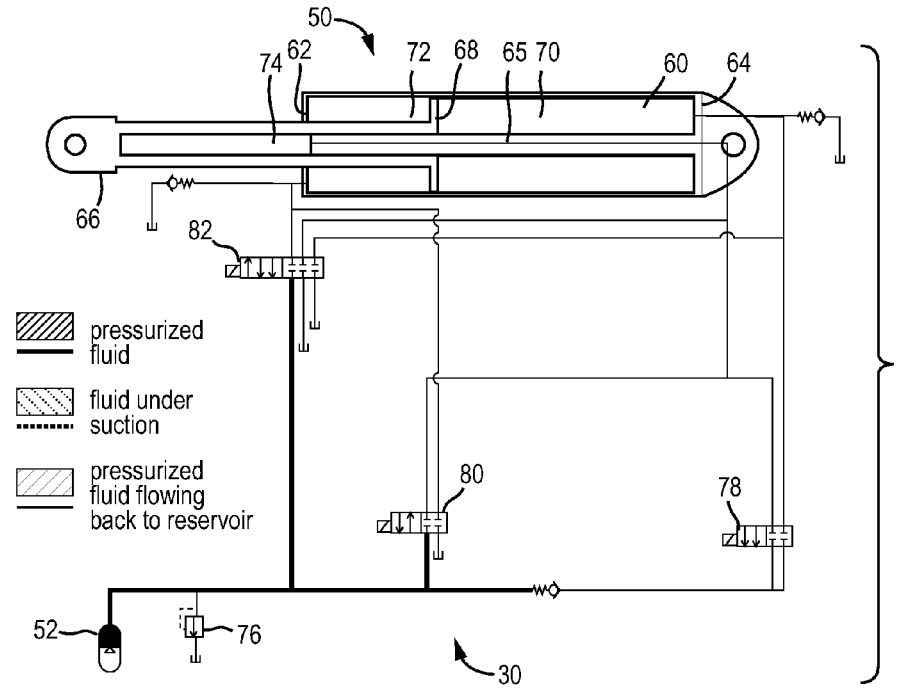
FIG. 6 is a schematic diagram of a hydraulic circuit for an energy capture mechanism utilizing a three-phase linear actuator in a neutral mode, in accordance with an exemplary embodiment.

Referring now to FIGS. 6-9, according to another exemplary embodiment, the actuator 50 may be a triple acting actuator. The triple acting actuator 50 has multiple interior chambers that can be pressurized in different combinations, allowing the actuator to operate as a variable force and variable speed actuator. When the load is small the actuator 50 can move (i.e. extend or contract) quickly with little force and as the load increases, the actuator 50 can change to move with increased force and decreased speed. As shown in FIG. 6, in one embodiment the actuator 50 includes a hollow barrel or cylinder 60 closed by a cylinder base 62 and a cylinder head 64. A piston rod 66 is coupled to a piston 68, which is moveable in the cylinder 60 and separates the interior of the cylinder 60 into a primary chamber 70 and a return chamber 72. The piston rod 66 is a hollow member forming a secondary chamber 74 that receives a secondary rod 65 coupled to the cylinder head 64. The primary chamber 70, the return chamber 72, and the secondary chamber 74 are in fluid communication with each other, an accumulator 52 and a fluid reservoir through a hydraulic circuit. The triple acting actuator 50 is analogous to the paired large bore actuator 56 and small bore actuator 58 described above. The large actuator formed by the piston 68 and the cylinder 60 is configured to support the high load of the bucket 20 and is responsible for most of the fluid being charged into the accumulator 52 when dumping. The smaller actuator formed by the secondary rod 65 and the hollow piston rod 66 cylinder is used primarily for maneuvering the empty bucket 20 into position.

The following is a stepped through example of a digging and dumping cycle for a bucket 20 equipped with an energy capture mechanism 30 with a triple acting actuator 50.

After fitting the bucket 20 to the drag rope 24 and the hoist rope 22, the actuator 50 is balanced and unpressurized and the accumulator 52 is charged (see FIG. 6). The bucket 20 is dragged along the ground to gather material with the spreader beam 28 resting fully forward, as shown in FIG. 4. At the end of the digging pass, the hoist rope 22 is taken up by the hoist machinery 16, lifting up on the spreader beam 28. As the spreader beam 28 pivots back on the pivots 42 (automatically or manually), pressurized fluid flows past a dump valve 78 charging the accumulator 52. Once the required balance/angle of the bucket 20 is reached, the dump valve 78 closes, allowing the loaded bucket 20 to lift from the ground.

This process of "pumping" the hydraulic fluid with the spreader beam 28 may occur at start up (e.g., before digging) to charge the accumulator 52 by lifting and lowering the hoist rope 22 while the bucket 20 is on the ground to cycle the spreader beam 28 between a forward position and a rearward position. According to an exemplary embodiment, the accumulator 52 may be charged when the bucket 20 is empty.

Figure 7:
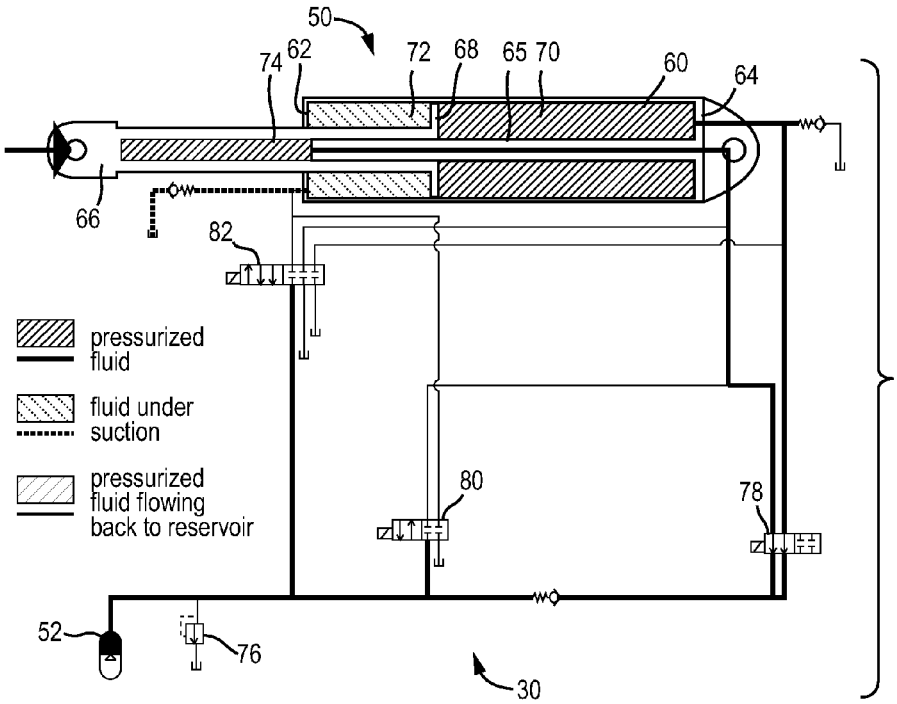
FIG. 7 is a schematic diagram of the hydraulic circuit of FIG. 6 in a dumping mode, in accordance with an exemplary embodiment.
Figure 8:
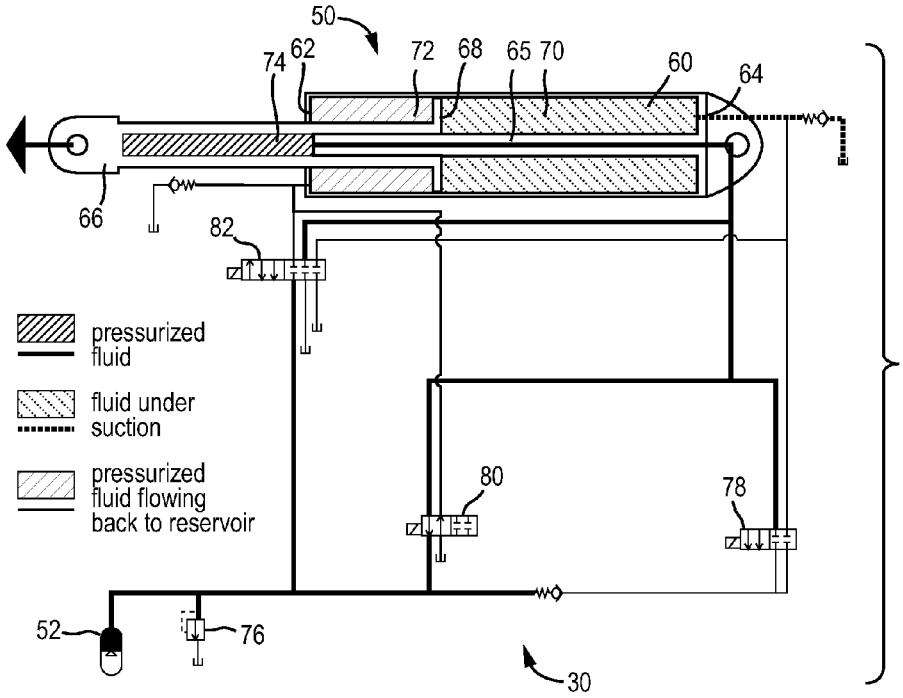
FIG. 8 is a schematic diagram of the hydraulic circuit of FIG. 6 in an up tilt mode, in accordance with an exemplary embodiment.
Figure 9:
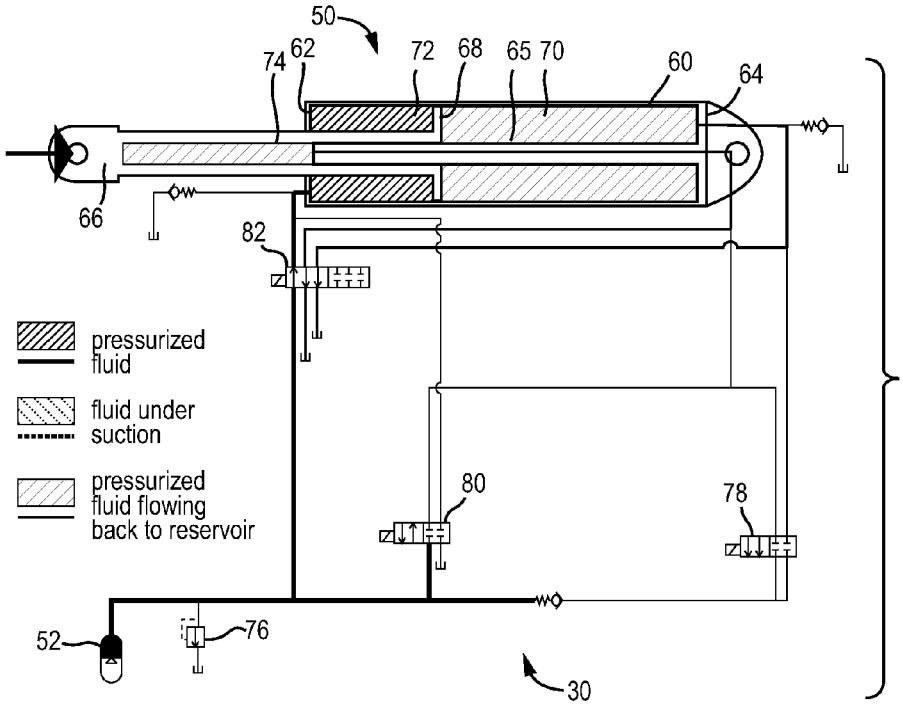
FIG. 9 is a schematic diagram of the hydraulic circuit of FIG. 6 in a down tilt mode, in accordance with an exemplary embodiment.

Once the bucket 20 is off the ground, the energy capture mechanism 30 allows the bucket 20 to be positioned and dumped wherever the operator wishes (see FIG. 7). When the bucket 20 is in the desired dumping position, the dump valve 78 is released. With the dump valve 78 released, pressurized fluid is forced out of both the primary chamber 70 and the secondary chamber 74 and fluid is drawn into the return chamber 72, contracting the actuator 50. The contraction of the actuator 50 allows the spreader beam 28 to rotate backwards and the bucket 20 to tilt down under the weight of the payload, dumping the load out of the open front end 32, as shown in FIG. 3. As the bucket 20 tilts downward, the bulk of the high pressure fluid is forced through the energy capture mechanism 30 into the accumulator 52. A pressure relief valve 76 allows excess fluid to bypass the accumulator 52 to the reservoir if the accumulator 52 becomes overcharged.

The energy stored in the energy capture mechanism may be utilized to position the bucket 20 to a desired angle for the next digging pass. Once the bucket 20 is dumped, according to an exemplary embodiment, the center of gravity of the bucket 20 is at or near the pivot point 42 of the spreader beam 28 such that minimum pressure is required to tilt the bucket 20 into a desired position. The bucket 20 may be tilted upward by opening the bucket up valve 80, allowing pressurized fluid from the accumulator 52 to be forced into the secondary chamber 74 of the actuator 50 while forcing fluid back out of the return chamber 72 and causing the actuator 50 to extend (see FIG. 8). The bucket 20 may be tilted downward by opening the bucket down valve 82, allowing pressurized fluid from the accumulator 52 to be forced into the return chamber 72 of the actuator 50 while forcing fluid out of the primary chamber 70 and the secondary chamber 74 and causing the actuator to contract (see FIG. 9). Because the extension of the actuator 50 is achieved by the small bore actuator formed by the secondary rod 65 and the hollow piston rod 66, less stored energy is used than would be used to reposition the bucket 20 using the large bore actuator formed by the piston 68 and the cylinder 60.

Tilting the bucket 20 back and forth excessively between dumping will expel all the energy stored in the energy capture mechanism 30. However, if operated efficiently, the bucket 20 can be positioned between digging passes without any external energy input, using only energy stored in the energy capture mechanism 30.

Figure 10:
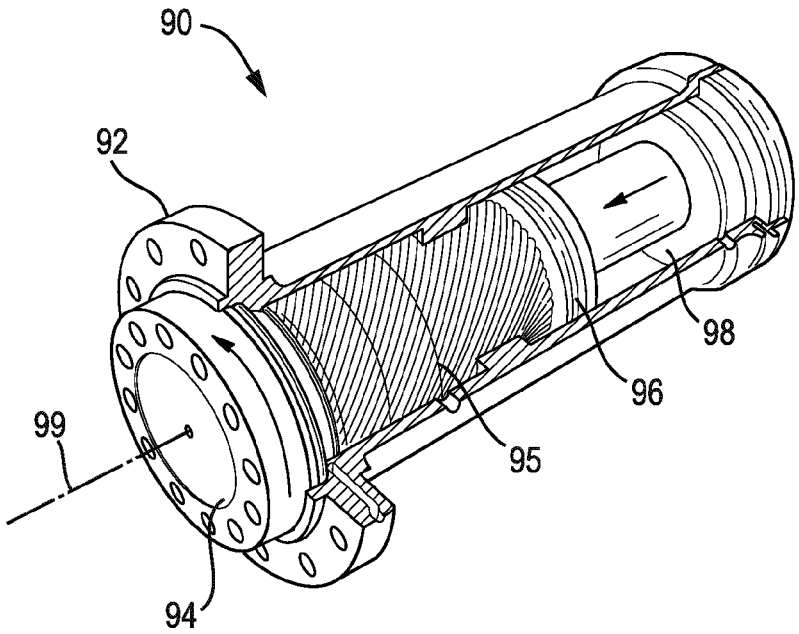
FIG. 10 is a partial cutaway perspective view of a helical hydraulic rotary actuator, in accordance with an exemplary embodiment.

While the energy capture mechanism 30 has been described as utilizing a linear actuator, in other embodiments, the energy capture mechanism may utilize another type of actuator to store energy as the bucket 20 is selectively dumped and use that energy to reposition the bucket 20. According to another exemplary embodiment, the actuator may be a rotary actuator 90, shown in FIG. 10 as a helical, hydraulic L30 rotary actuator as sold by the Helac Corporation. The rotary actuator 90 includes an outer portion 92, an inner portion 94 coaxial with and rotatable relative to the outer portion 92, and a piston 96 received in the outer portion 92. The piston 96 defines an interior chamber 98 in outer portion 92. The piston 96 translates along the rotational axis 99 of the inner portion 94 and the outer portion 92 in response to the addition or removal of hydraulic fluid from the chamber 98. The inner portion 94 engages the piston 96 with a helical gear interface 95 such that a linear movement of the piston 96 corresponds to a rotational movement of the inner portion 94 relative to the outer portion 92. Such rotary actuators 90 can rotate up to 360 degrees. Rotary actuators 90 as shown in FIG. 10 are relatively strong, and typically have a holding ability comparable to a linear hydraulic actuator.

Figure 11:
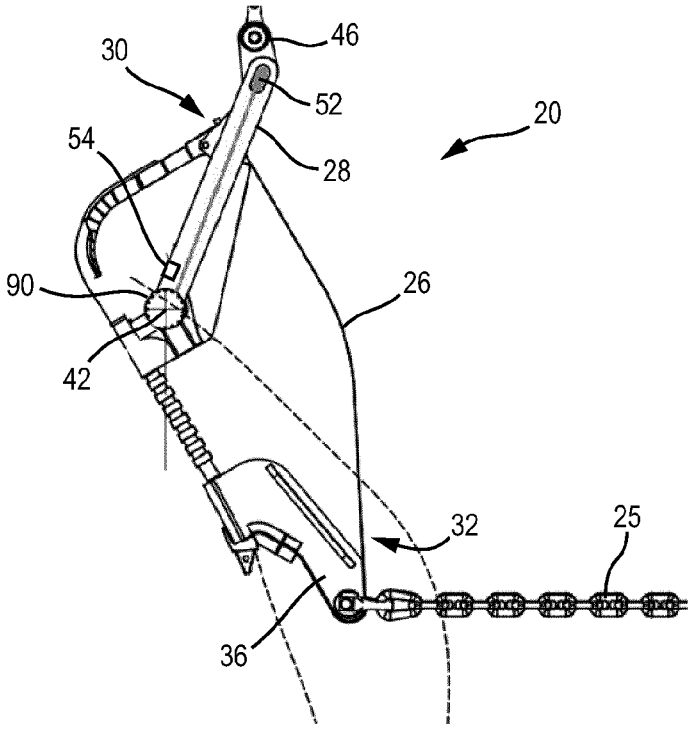
FIG. 11 is a schematic side view of the bucket of FIG. 2 with a rotary actuator provided at the pivot point, in accordance with an exemplary embodiment.

Referring now to FIG. 11, the energy capture mechanism 30 may include a rotary actuator 90 aligned with the pivot point 42 of the pivotable spreader beam 28. The actuator 90 is coupled between the spreader beam 28 and the main body 26 of the bucket 20 (e.g., with the outer portion 92 coupled to the main body 26 and the inner portion 94 coupled to the spreader beam 28). As the bucket 20 moves into a dumping position, emptying the collected material out of the open end 32, the weight of the material payload rotates the inner portion 94 relative to the outer portion 92. The rotation of the inner portion 94 moves the piston 96 along the axis 99 and compresses hydraulic fluid from the actuator 50 into the accumulator 52. This compressed fluid may be utilized later in the digging cycle to operate the actuator 50 and adjust the now empty bucket 20 into position for the next digging pass. In addition to capture energy from the dumping operation, a rotary actuator 90 at the pivot point 42 serves as a bearing/bushing to facilitate the rotation of the bucket 20 about the pivot point 42. Similar to the energy capture mechanism 30 of FIG. 3, a wireless receiver 54 may receive control signals remotely from the operator to operate that actuator 90.

Figure 12:
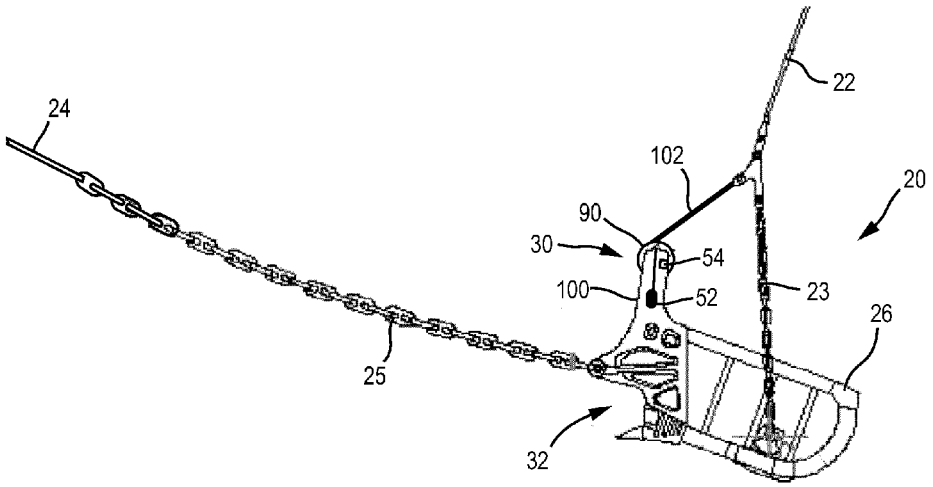
FIG. 12 is a schematic side view of a conventional dragline bucket with a rotary actuator provided on the bucket arch in accordance with an exemplary embodiment.
Figure 13:
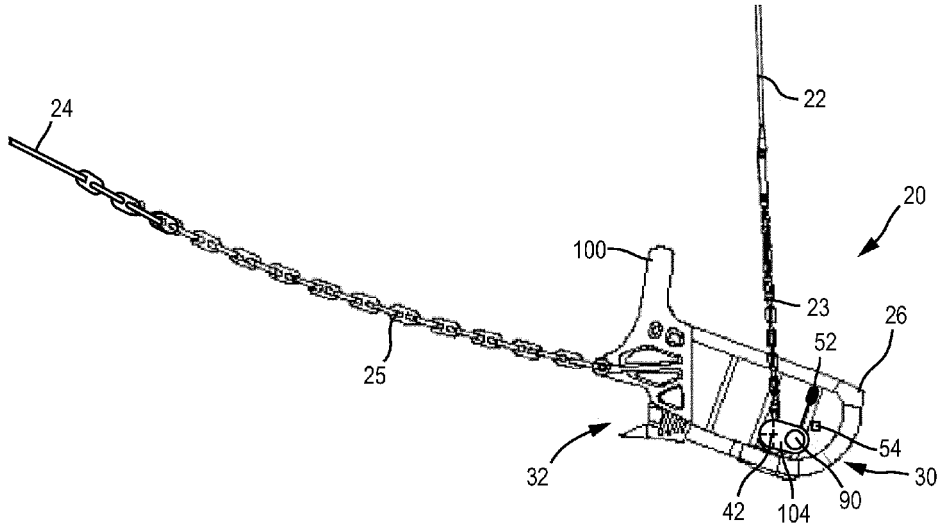
FIG. 13 is a schematic side view of a conventional dragline bucket with a rotary actuator provided offset from the pivot point, in accordance with an exemplary embodiment.

Referring now to FIGS. 12-13, according to another exemplary embodiment, an energy capture mechanism 30 with a rotary actuator 90 may be used on a dragline bucket 20 with a forward arch 100. As shown according to one exemplary embodiment in FIG. 12, the rotary actuator 90 with a sheave/reel may be coupled to the arch 100 where the dump rope 102 is coupled to the arch 100. The dump rope 102 extends from the hoist rope 22 and is taken up on the reel coupled to the rotary actuator 90. By paying off or taking up the dump rope 102, the rotation or tilt of the bucket 20 may be controlled by an operator remotely through the receiver 54. As shown according to another exemplary embodiment in FIG. 13, the rotary actuator 90 may be coupled to the bucket 20 proximate to the attachment point for the hoist chains 23 (e.g., near the pivot point 42). The rotary actuator is coupled to the bucket 20 and to the hoist chain 23 via an eccentric cam member 104. Through the rotation of the actuator 90, the cam 104 moves the hoist chain 23 to dump the bucket 20. An existing conventional dragline bucket may be retrofitted with the energy capture mechanism 30 as shown in FIG. 12 or 13 to provide remote bucket control and energy capture functionality without modifications to other components of the dragline, such as the boom 14, the hoist machinery 16, or the drag machinery 18.

The energy capture mechanism as described above in various embodiments allows the dragline bucket to be directly controlled from the cab of the machine, dumping the contents of the bucket at any location along the digging path of the bucket. Further, a bucket utilizing the energy capture mechanism may not require a dump rope and sheaves, thereby reducing the number of components and weight of the bucket. Unlike a universal dig dump mechanism, the energy capture mechanism as described does not require modifications to existing dragline components (e.g., the boom, the hoist drum, the hoist gearcases, ballast, etc.). Because the energy capture mechanism includes only modifications to the bucket and the hoist jewelry, the energy capture mechanism may be relocated from dragline to dragline (i.e., provided on another dragline). Additionally, because the energy capture mechanism does not require multiple hoist ropes coupled to the front and back of the bucket, a bucket utilizing the energy capture mechanism requires reduced maintenance compared to a universal dig dump mechanism.

The construction and arrangements of the bucket assembly, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A dragline bucket, comprising:

a main body moveable between a digging orientation and a dumping orientation;

a pivotable spreader beam coupled to the main body at a pivot point, wherein the main body is configured to move from the digging orientation to the dumping orientation by rotating downward about the pivot point relative to the pivotable spreader beam in order to empty the contents of the bucket; and an energy capture mechanism comprising:

an actuator coupled to the main body and the pivotable spreader beam; and an energy storage device coupled to the actuator, wherein the main body is configured to compress the actuator when the main body moves from the digging orientation to the dumping orientation, causing the actuator to transfer energy to the energy storage device.

2. The dragline bucket of claim 1, wherein the energy storage device transfers at least some of the stored energy to the actuator in order to move the main body from the dumping orientation to the digging orientation by extending the actuator.

3. The dragline bucket of claim 2, wherein the energy capture mechanism comprises a hydraulic system.

4. The dragline bucket of claim 3, wherein the energy storage device comprises a hydraulic accumulator.

5. The dragline bucket of claim 4, wherein the actuator comprises a small bore linear actuator and a large bore linear actuator, wherein both the small bore linear actuator and the large bore linear actuator are compressed to transfer energy to the energy storage device when the main body moves from the digging orientation to the dumping orientation, and wherein only the small bore linear actuator is extended to actuate movement of the main body from the dumping orientation to the digging orientation.

6. The dragline bucket of claim 4, wherein the actuator comprises a multiphase linear actuator comprising a first chamber, a second chamber, and a third chamber, the third chamber having a cross-sectional area that is less than the cross-sectional area of the first chamber; wherein a volume of fluid forced into one of the first chamber or the third chamber moves the actuator in a first direction and the volume of fluid forced into the second chamber moves the actuator in an opposite direction.

7. The dragline bucket of claim 6, wherein the volume of fluid forced into the first chamber moves the actuator at a first speed with a first force and wherein the volume of fluid forced into the third chamber moves the actuator as a second speed with a second force, the first speed being less than the second speed and the first force being greater than the second force.

8. The dragline bucket of claim 4, wherein the actuator comprises a rotary actuator.

9. The dragline bucket of claim 8, wherein the rotary actuator is coupled to the pivot point of the pivotable spreader beam.

10. The dragline bucket of claim 1, wherein the energy capture mechanism receives remote instructions through a remote control unit coupled to the bucket.

* * * * *